United States Patent [19]

Kohrs

[11] 4,167,249

[45] Sep. 11, 1979

[54] STOCK PULPER FOR PULPING AND SORTING WASTE PAPER

[75] Inventor: Manfred Kohrs, Ravensburg, Fed. Rep. of Germany

[73] Assignee: Sulzer Brothers Limited, Winterthur, Switzerland

[21] Appl. No.: 849,258

[22] Filed: Nov. 7, 1977

[30] Foreign Application Priority Data

Nov. 16, 1976 [CH] Switzerland ..... 14381/76

[51] Int. Cl.[2] ..... B02C 23/36

[52] U.S. Cl. ..... 241/46.17

[58] Field of Search ..... 241/46.17

[56] References Cited

U.S. PATENT DOCUMENTS

| | | | |
|---|---|---|---|
| 3,844,488 | 10/1974 | Neitzel | 241/46.17 |
| 3,859,206 | 1/1975 | Baggaley | 241/46.17 |
| 3,942,728 | 3/1976 | Christ et al. | 241/46.17 |
| 3,945,576 | 3/1976 | Kahmann | 241/46.17 |
| 4,030,671 | 6/1977 | Couture | 241/46.17 |

*Primary Examiner*—Howard N. Goldberg

*Attorney, Agent, or Firm*—Kenyon & Kenyon

[57] ABSTRACT

The stock pulper is disposed on a vertical axis with an outlet for impurities of low specific gravity at the top. The wall of the stock pulper is conical with an upwardly directed apex to assist in the separation of the impurities. The top end wall of the stock pulper is also conical with an upwardly directed apex to facilitate the outflow of the impurities of low specific gravity. The outlet for high specific weight impurities is located at the bottom of the stock pulper.

6 Claims, 4 Drawing Figures

STOCK PULPER FOR PULPING AND SORTING WASTE PAPER

This invention relates to a stock pulper and, particularly, to a stock pulper for pulping and sorting waste paper.

Heretofore, various stock pulpers have been known for the pulping and sorting of waste paper. Generally, these stock pulpers have been constructed with an enclosed container essentially in the form of a body of revolution having a conical circumferential wall, a front wall and an end wall. In addition, a rotor is usually placed adjacent to a screen in the front wall with radial arms for pumping good stock from the container through the screen and into a discharge pipe. In some cases, an outlet opening for leading off the specifically light impurities is provided in the end wall opposite the rotor essentially on the axis of the container. An outlet opening is also provided in the lower portion of the container for extracting heavy impurities.

As described, for example in German Pat. No. 965,806 and U.S. Pat. Nos. 3,945,576 and 3,942,728, the known stock pulpers are usually disposed with their axes horizontal and with the outlet pipe for the specifically light impurities being likewise led out horizontally from the container in the axial direction. This configuration usually permits a relatively reliable removal of the specifically light impurities. However, if the flow intensity within the container is not sufficient, there is a danger that the specifically light impurities, such as frothed stock, may be able to move up and out of the axial zone so that a separation of these impurities through the proper outlet is not obtained. Further, in some instances, the specifically heavy impurities are circulated within the containers over relatively long flow paths before exiting. This can lead to severe wear and tear on the containers as well as on the moving parts of the stock pulpers.

Accordingly, it is an object of the invention to provide a stock pulper in which the impurities of a stock suspension can be reliably and quickly separated and removed.

It is another object of the invention to obtain a rapid separation of impurities of low specific gravity for a stock suspension.

It is another object of the invention to reduce the wear and tear on a stock pulper for pulping and sorting waste paper.

Briefly, the invention provides a stock pulper for pulping waste paper and for sorting a recovered stock suspension which is vertically disposed. To this end, the stock pulper has an enclosed container which is essentially in the form of a body of revolution with a bottom end wall, a conical circumferential wall disposed on a vertical axis with an upwardly directed apex and a conical top end wall having an upwardly directed apex.

In addition, a screen is disposed in the bottom end wall and a rotor with a plurality of arms is disposed adjacent the screen to pulp good stock through the screen from within the container.

The stock pulper is also provided with an inlet for introducing a waste paper suspension into the container and three outlets. A first outlet is disposed in communication with the screen to remove good stock from the container, a second outlet is disposed in communication with a lower portion of the container for removing impurities of heavy specific gravity from the container and a third outlet is connected to the top end wall on the axis of the container for removing impurities of low specific gravity from the container. With the vertical arrangement of the container and with the outlet for the low specific gravity impurities at the top, the separation of these impurities is assisted because they tend naturally to rise in opposition to the force of gravity. In contrast, with the container disposed horizontally there is a danger that, if the flow intensity is not sufficient, the lightweight impurities, such as frothed stock for example, may be able to move up out of the axial zone so that their separation through the outlet in question is made difficult.

The outlet for the high specific gravity impurities is arranged so that any heavy metallic particles and the like in the waste paper are removed very quickly. In this way, severe wear and tear on the container and the moving parts of the stock pulper due to the heavy particles are avoided. In addition, a recess may be formed in the container in communication with the outlet for the heavy specific gravity impurities. The separation of the heavy specific gravity impurities is greatly assisted by this, because the recess enables the impurities to be let into the outlet more easily. Preferentially, the recess may be in the form of a channel with a depth increasing in the direction of rotation of the rotor and which terminates in an essentially radial and vertical wall. The outlet is situated at the lowest point in the channel. In this way, a particularly suitable recess shape is obtained, which assists speedy separation of the heavy constituents.

It is also possible however to provide the outlet for the heavy specific gravity impurities with a guide plate which projects into the container space to assist the inflow into the outlet. In this way, a similar effect is obtained to the recess, using simpler means. Of course, the guide plate may also be combined with the recess.

These and other objects and advantages of the invention will become more apparent from the following detailed description taken in conjunction with the accompanying drawings in which.

Figure 1:
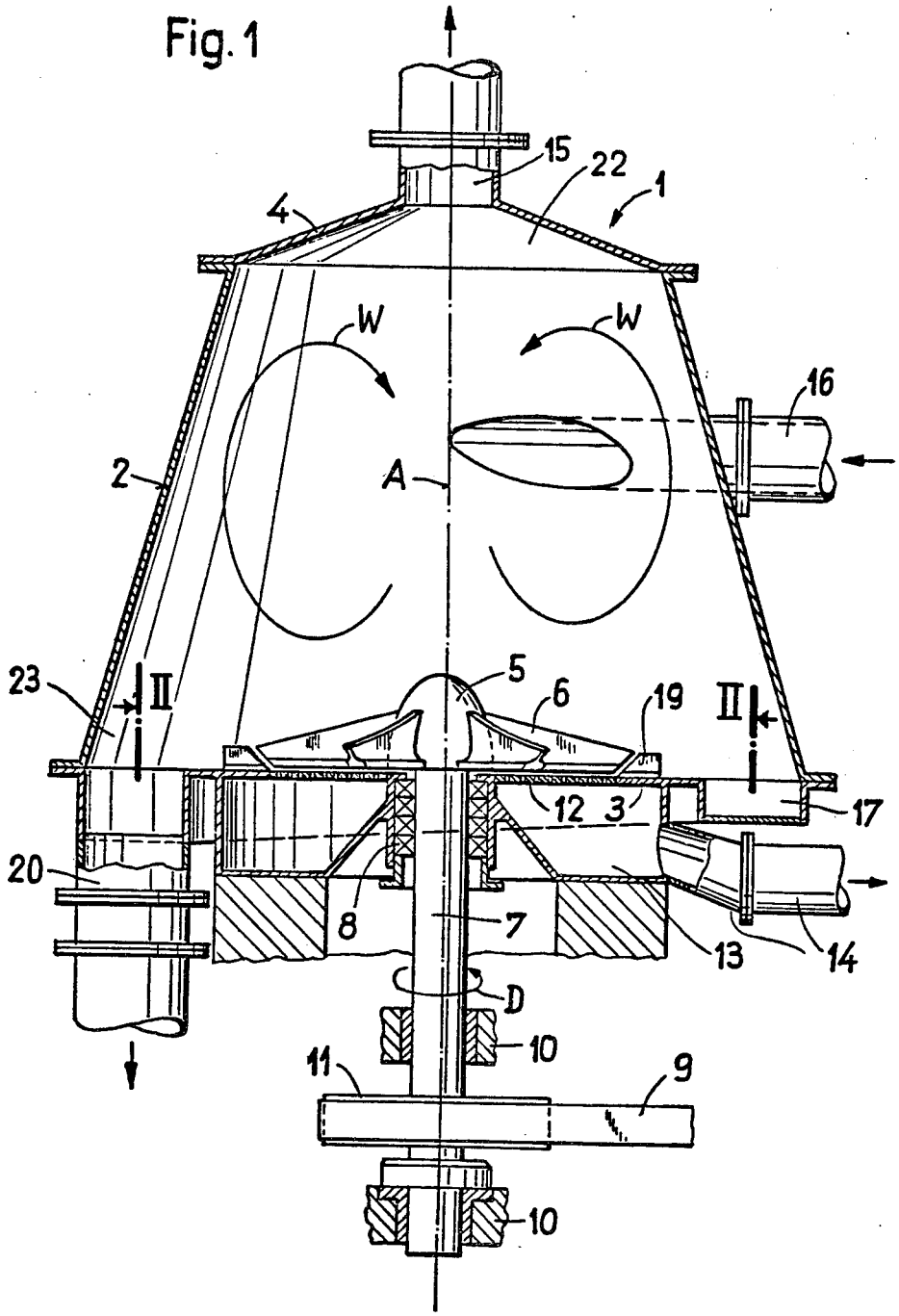
FIG. 1 illustrates a section of a stock pulper according to the invention.

Referring to FIG. 1, the stock pulper has a container 1 which is essentially in the form of a body of rotation on a vertical axis A. The container 1 has a conical circumferential wall 2, a bottom end wall 3 and a conical top end wall 4. A rotor 5 is situated at the bottom wall 3 and has a plurality of radial arms 6 located adjacent to the wall 3. The rotor 5 is fixed on a shaft 7, which is led through a seal 8 in the wall 3 and is mounted rotatably in the bearings 10. In order to drive the shaft 7, a belt is secured to the shaft 7 and a belt 9 which leads to the belt pulley of a motor (not shown) is guided over the pulley 11. As shown, the conical circumferential wall 2 extends from the bottom end wall 3 while the top end wall 4 extends from the circumferential wall 2.

A perforated screen or plate 12 is arranged in the wall 6 below the rotor 5, through which good stock recovered from a pulped waste paper suspension in the container is able to pass into a good stock chamber 13. This chamber 13 communicates directly with an outlet in the form of a pipe 14 through which good stock can be removed. A plurality of dogs 19 are arranged on the wall 3 in a circle around the rotor 5 and outside the plate 12 to assist the shredding action of the rotor 5.

As shown in FIG. 1, the circumferential wall 2 is conical, with an upwardly directed apex. The same is true of the end wall 4, which, however, has a larger cone angle. In addition, the container 1 is provided with an inlet and three outlets. The inlet is located above the mid-point of the container 1 and is connected with an inlet pipe 16 for the introduction of a waste paper suspension into the container 1 from a suitable source (not shown). The inlet and the inlet pipe 16 are both disposed tangentially of the container 1.

One outlet 14 is located at a lower end of the chamber 13 and is connected to an outlet pipe in order to remove the good stock from the chamber 13 and, thus, the container 1. The second outlet 20 is located in communication with a lower portion of the container 1 and is connected to an outlet pipe for removing impurities of heavy specific gravity from the container 1. The third outlet 15 is located in the top end wall 4 on the axis of the container 1 and is connected to an outlet pipe for removing inpurities of low specific gravity from the container 1. As shown, the outlets 14, 15, 20 extend away from the container 1.

Figure 2:
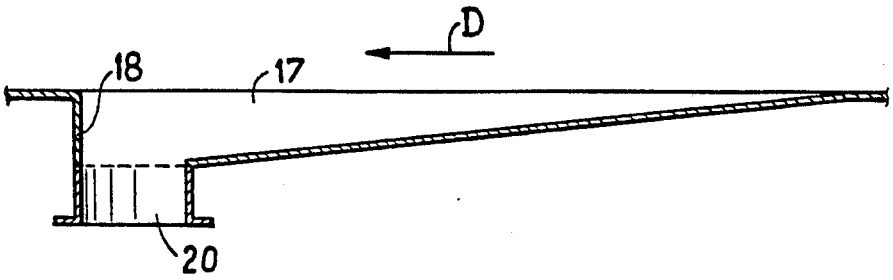
FIG. 2 illustrates a development from FIG. 1 along line II—II of FIG. 1.

Referring to FIGS. 1 and 2, a channel or recess 17 is formed about the circumference of the bottom wall 3 with a depth increasing in the direction of rotation and terminating in an essentially radial and vertical wall 18. The outlet 20 for the heavy materials separated from the container is located at the lowest point of the channel 17.

Figure 3:
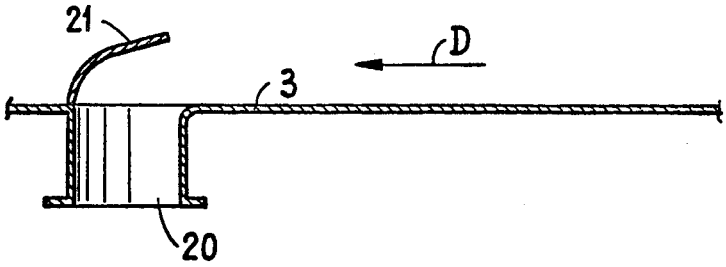
FIG. 3 illustrates a sectional view of a guide plate used with an outlet for impurities of heavy specific gravity in accordance with the invention.

Referring to FIG. 3, the bottom wall 3 may also be flat, i.e. without the channel 17 at the circumference. In this case, a guide plate 21 is located on the downstream side of the outlet 20 as viewed in the direction of rotation D of the rotor. This guide plate 21 assists the inflow of the heavy materials to be separated into the outlet 20.

In operation, a stock fluid containing already pretreated though as yet incompletely pulped and purified fiber matter such as waste paper, is led into the container 1 through the inlet pipe 16, for example after pretreatment in a pulper. The fluid may still contain pieces of paper, plastic films, bits of foamed plastic as well as heavy particles like staples and other metallic objects and miscellaneous foreign matter such as stones, glass splinters and the like.

Under the action of the rotor 5 in the container 1, the suspension is subjected to a rotary flow about the axis A as well as to a circulating motion as indicated by the arrows W. The lightweight constituents, i.e. the impurities of low specific gravity gather at the center of the rotary flow, and may be drawn off through the outlet 15. Extraction is assisted by the conical shape of the top end wall 4, which induces a rather more quiescent region 22 with a weaker circulating motion close to the outlet 15.

The heavy materials, i.e. the impurities of high specific gravity, present in the fluid are flung out by centrifugal force into the angular zone 23 between the circumferential wall 2 and the bottom wall 3. This rapid motion is assisted by the cone angle of the circumferential wall 2. The heavy particles then pass into the recess 17 and inpact against the wall 18, after which these impurities are led off through the outlet 20. With the embodiment according to FIG. 3, the heavy materials impact against the guide plate 21 and are led into the outlet 20.

Of course, the embodiment illustrated in the drawing is only one example, which can be modified in various ways. Thus, for example, the outlet 20 together with the recess 17 or the guide plate 21 may be situated at the bottom edge of the circumferential wall 2 instead of in the bottom wall 3. The recess 17 illustrated in FIG. 2 may thereby extend over the full circumference of the container 1 or only part of this circumference.

Figure 4:
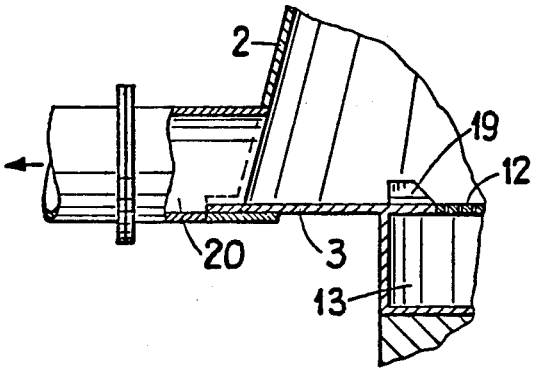
FIG. 4 illustrates a part view of a stock pulper having an outlet for impurities of heavy specific gravity in the circumferential wall.

The recess 17 or guide plate 21 may also be omitted, as illustrated in FIG. 4, wherein like reference characters indicate like parts as above. Also shown is an arrangement whereby the outlet 20 is situated at the bottom edge of the circumferential wall 2 and not in the bottom wall 3 as in FIG. 1. Of course, the outlet 20 according to FIG. 4 may also be combined with a recess 17 according to FIG. 2 or with a guide plate 21 according to FIG. 3.

The perforated plate 12 which serves to sort, i.e. screen the good stock may be flat as illustrated in FIG. 1, but may also be conical, projecting into the container 1 in accordance with U.S. Pat. No. 3,945,576.

What is claimed is:

1. A stock pulper for pulping waste paper and for sorting a recovered stock suspension, said stock pulper comprising;

an enclosed container having essentially the form of a body of revolution with a bottom end wall, a conical circumferential wall extending from said bottom end wall on a vertical axis with an upwardly directed apex and a conical top end wall extending from said circumferential wall and having an upwardly directed apex;

a screen in said bottom end wall;

a rotor having a plurality of arms disposed adjacent to said screen to pulp good stock through said screen;

an inlet for introducing a waste paper suspension into said container;

a first outlet in communication with said screen to remove good stock from said container;

a second outlet in communication with a lower portion of said container for removing impurities of heavy specific gravity from said container; and a third outlet located in said top end wall on said axis for removing impurities of low specific gravity from said container.

2. A stock pulper as set forth in claim 1 wherein one of said bottom end wall and said circumferential wall has a recess therein communicating with said second outlet.

3. A stock pulper as set forth in claim 2 wherein said recess is in the form of a channel with a depth increasing in the direction of rotation of said rotor and with a radial and vertically disposed terminal wall, said second outlet being connected to the lowest point of said channel.

4. A stock pulper as set forth in claim 1 which further comprises a guide plate projecting into said container adjacent said second outlet to assist an inflow into said second outlet.

5. A stock pulper as set forth in claim 1 wherein said second outlet is disposed at the circumferential periphery of said bottom end wall.

6. A stock pulper as set forth in claim 1 wherein said second outlet is disposed at the bottom of said conical circumferential wall.

* * * * *